US007635125B2

(12) United States Patent
Ikeda

(10) Patent No.: US 7,635,125 B2
(45) Date of Patent: Dec. 22, 2009

(54) SHEET FEEDING APPARATUS AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 11/741,843

(22) Filed: Apr. 30, 2007

(65) Prior Publication Data

US 2007/0284805 A1 Dec. 13, 2007

(30) Foreign Application Priority Data

May 12, 2006 (JP) ..... 2006-134530

(51) Int. Cl.
*B65H 7/02* (2006.01)

(52) U.S. Cl. ..... 271/31; 271/98; 271/152

(58) Field of Classification Search ..... 271/97, 271/98, 31, 30.1, 152
See application file for complete search history.

(56) References Cited

U.S. PATENT DOCUMENTS 5,645,274 A * 7/1997 Ubayashi et al. ..... 271/94
7,364,150 B2 * 4/2008 Nakane ..... 271/97
2002/0005610 A1 * 1/2002 Moore et al. ..... 271/11
2005/0206068 A1 * 9/2005 Sasaki et al. ..... 271/98
2006/0012107 A1 * 1/2006 Ueda et al. ..... 271/98
2007/0228639 A1 * 10/2007 Matsumoto et al. ..... 271/97

FOREIGN PATENT DOCUMENTS

JP 7-196187 8/1995

* cited by examiner

*Primary Examiner*—Patrick H Mackey
*Assistant Examiner*—Ernesto Suarez
(74) *Attorney, Agent, or Firm*—Fitzpatrick, Cella, Harper & Scinto

(57) ABSTRACT

An air blowing portion blows air to the end of sheets supported by a lifting and lowering tray. The sheets blown up by the air from the air blowing portion are sucked and conveyed by a sucking and conveying portion. The sheets are preliminarily blown up above the suckable rang. Then, the sheets are lowered to the suckable range before a sucking and conveying operation is started. In the above operation, the tray is lifted, and thereafter the tray is lowered until the sheets reach the suckable range while repeating a step operation of performing a lowering operation and a stop operation based on detection of the upper surface of the sheets by a sheet detecting mechanism.

8 Claims, 14 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus and, more particularly, to the one in which sheets are separated and fed by blowing an air to the sheets.

2. Description of the Related Art

Conventionally, an image forming apparatuses such as a printer and a copying machine is provided with a sheet feeding apparatus of feeding sheets one by one from a sheet containing portion in which a plurality of sheets is contained. Furthermore, there has been such a sheet feeding apparatus of air sheet feeding type, as described in Japanese Patent Application Laid-Open No. H07-196187, in which air is blown to the end of a sheet stack contained in a sheet containing portion to blow up several sheets, and the uppermost sheet is sucked to a sucking and conveying belt disposed thereabove to be conveyed.

FIG. 11 illustrates one example of a sheet feeding apparatus of such an air sheet feeding type. As illustrated in FIG. 11, a tray 12 on which a plurality of sheets S are stacked is disposed so as to be capable of being lifted or lowered in a storage 11, being a sheet containing portion in which the plurality of sheets S is contained. Moreover, there is provided above this storage 11 a sucking and conveying portion 50A sucking and conveying the sheet S. Furthermore, there is provided on the side of the storage 11 an air blowing portion 30 for blowing air to the end of a sheet stack on the tray 12 to blow up several sheets S, as well as to separate them from one another.

The sucking and conveying portion 50A includes a sucking and conveying belt 21 passed over belt driving rollers 41, as well as sucking and conveying the sheet S rightward in FIG. 11, and a suction fan 36 generating a negative pressure for causing the sucking and conveying belt 21 to suck the sheet S. Further, a suction duct 51 is disposed inside the sucking and conveying belt 21, and acting to suck in air via suction holes formed in the suction belt 21. Furthermore, in order to make ON/OFF of a sucking operation performed by the suction fan 36, a suction shutter 37 is disposed between the suction fan 36 and the sucking and conveying belt 21.

Moreover, the air blowing portion 30 includes a loosening nozzle 33 and separation nozzle 34 for blowing air to the upper portion of the contained sheet stack, a separation fan 31, and a separation duct 32 supplying air from the separation fan 31 to each nozzle 33, 34.

An air having sucked in the direction indicated by arrows C by the separation fan 31 is blown in the direction indicated by arrows D by the loosening nozzle 33, and blown in the direction indicated by arrows E by the separation nozzle 34. Then, by the air blown, several sheets at the upper portion of the sheet stack supported on the tray 12 are blown up, and an uppermost sheet Sa is separated from the blown up sheets.

Now, an initial operation in the sheet feeding apparatus of such construction will be described with reference to FIGS. 12A, 12B, 13A, and 13B. Note that, the initial operation is an operation in which after the refill of sheets and the like, the tray 12 is preliminarily lifted or lowered so that the uppermost sheet Sa of sheets S on the tray 12 is moved to the suckable range where the sheet can be sucked with a sucking and conveying belt 21.

When the initial operation is started, as illustrated in FIG. 12A, the tray 12 on which the sheets S are stacked is lifted.

Then, when the distance between the uppermost sheet Sa and the sucking and conveying belt 21 becomes a predetermined distance B, a sheet detecting mechanism (not shown) makes detection to stop lifting of the tray 12.

Subsequently, prepared for a sheet feed signal generated thereafter, as illustrated in FIG. 12B, to loosen sheets, an air is blown to the end of sheets S from the loosening nozzle 33 and the separation nozzle 34. Here, although when an air is blown to the sheets S, upper sheets of the sheet stack are blown up, as illustrated in the encircled portion designated by SG of FIG. 13A, they may be blown up densely. To dissolve the blown up dense sheets, as illustrated in FIG. 13A, an operation of lowering (moving in the direction indicated by an arrow F) the tray 12 is performed after air is blown.

Then, when the tray 12 is lowered like this, as shown in FIG. 13B, the blown up dense sheets are loosened, and the blown up sheets are in the state of being at approximately equally spaced intervals S1. At this time, supposing that the space PB1 between the uppermost sheet Sa and the sucking and conveying belt 21 is an adequate space in which only one sheet can be sucked, the tray 12 is stopped to wait for a sheet feed signal. Upon receiving the sheet feed signal, the sucking and conveying belt 21 sucks the sheet Sa and is rotated, thereby separating and conveying the sheet Sa.

However, in the case of a small basis weight of sheet (thin and light sheet), even if blown up sheets are in the state of being at approximately equally spaced intervals, the space PB1 between the uppermost sheet Sa and the sucking and conveying belt 21 comes not to be larger, and the uppermost sheet Sa may not be positioned with the adequate space relative to the sucking and conveying belt 21. Therefore, there is a possibility that by a suction force of the sucking and conveying belt 21, through the uppermost sheet Sa, the next sheet is sucked, resulting in the occurrence of separation failure. Accordingly, to obtain the adequate space in which only the uppermost sheet Sa can be sucked, the tray 12 continues to be lowered.

Whereby, as illustrated in FIG. 14A, the blown up sheets will be blown up with the space between the uppermost sheet Sa and the sucking and conveying belt 21 becoming larger by degrees, as well as, gradually with the space S2 larger than the space S1 as illustrated in FIG. 13B. Even in the case, however, where the space between the blown up sheets becomes larger, the space between the uppermost sheet Sa and the sucking and conveying belt 21 may not be changed largely. In this case, the tray 12 further continues to be lowered continuously.

Then, by the tray 12 being lowered, the space PB1 between the uppermost sheet Sa and the sucking and conveying belt 21 becomes larger by degrees. As compared therewith, however, when the amount of the tray 12 being lowered comes to be extremely large, the buoyancy of sheets is sharply decreased, and thus the sheets cannot continue to be blown up.

As a result, as illustrated in FIG. 14B, the blown up sheets rapidly drop by a distance N1 in the direction indicated by an arrow F of FIG. 14B. Whereby, the space between the uppermost sheet Sa and the sucking and conveying belt 21 becomes PB2, and thus the space is suddenly changed to be too large. That is, the position of the uppermost sheet Sa will be below the suckable range in which the sucking and conveying belt 21 can suck a sheet.

In this state, the tray 12 stops to be lowered, and will start to be lifted in the direction indicated by an arrow A of FIG. 14B. However, the tray 12 is lifted like this, and thereafter in the case where the sheets S are blown up densely as illustrated in the already-described FIG. 12B, the tray 12 will start to be lowered again. Then, such a lifting and lowering operation is repeated many times.

When a lifting and lowering operation of the tray 12 is repeated many times like this, the uppermost sheet Sa is less likely to be positioned with stability, and will be blown up in an instable state. In case where a sheet feeding operation is started in such a state, which will result in a double feed or jam of sheets.

SUMMARY OF THE INVENTION

Thus, the present invention has been made in view of such existing conditions, and has an object of providing a sheet feeding apparatus and an image forming apparatus capable of moving an uppermost sheet to a suckable range rapidly and reliably at the time of an initial operation.

According to the present invention, a sheet feeding apparatus includes: a lifting and lowering tray which supports sheets; an air blowing portion blowing an air to an end of the sheets to blow up the sheets supported on the tray; a sucking and conveying portion sucking and conveying a sheet blown up with the air blown by the air blowing portion; and a sheet detecting mechanism for detecting an uppermost sheet of the sheets supported on the tray, wherein when the uppermost sheet blown up is lowered to a suckable range based on detection of an upper surface of the sheet by the sheet detecting mechanism before starting a sucking and conveying operation of a sheet with the sucking and conveying portion, the tray is lowered until the uppermost sheet reaches the suckable range while repeating a step operation in which a lowering operation and a stop operation are performed.

Further features of the present invention will become apparent from the following description of exemplary embodiments with reference to the attached drawings.

DESCRIPTION OF THE PREFERRED EMBODIMENT

Hereinafter, an exemplary embodiment for carrying out the present invention will be described in detail referring to the accompanying drawings.

Figure 1:
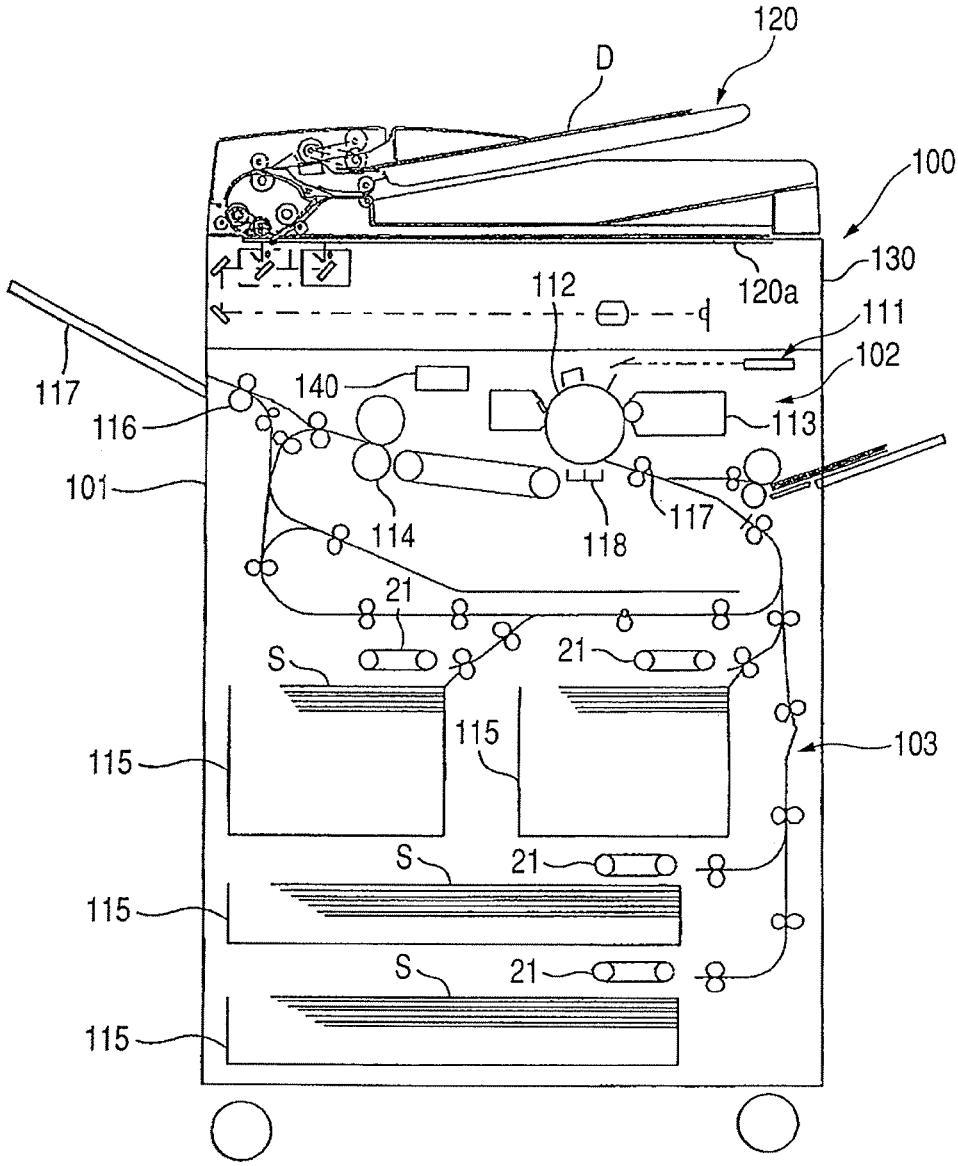
FIG. 1 is a view illustrating a schematic construction of a printer, being one example of an image forming apparatus provided with a sheet feeding apparatus according to an embodiment of the present invention.

FIG. 1 is a view illustrating a schematic construction of a printer, being one example of an image forming apparatus provided with a sheet feeding apparatus according to an embodiment of the present invention.

With reference to FIG. 1, at the upper portion of a printer main body 101 of a printer 100, there is provided an image reading portion 130 for reading a document D placed on a platen glass 120*a* acting as a document placement stand of an automatic document feeding apparatus 120. Further, there are provided under the image reading portion 130 an image forming portion 102 and a sheet feeding apparatus 103 feeding sheets S, which are contained in a storage 11 capable of being drawn out of the printer main body 101, to the image forming portion 102.

Here, the image forming portion 102 is provided with a photosensitive drum 112, a developing device 113, a laser scanner unit 111 and the like. And, the sheet feeding apparatus 103 is provided with a plurality of sheet containing portions 115 containing sheets S such as OHT to be removable with respect to the printer main body 101 and sucking and conveying belts 21, being feeding belts as an example of a sheet feeding unit feeding sheets S contained in respective sheet containing portions 115. In addition, a controller 140 is provided in a predetermined position of the printer main body 101.

Now, image forming operations of the printer 100 of such construction will be described.

When an image read signal is output from the controller 140 provided at the printer main body 101 to the image reading portion 130, an image is read with the image reading portion 130. Thereafter, a laser beam in response to this electrical signal is irradiated onto the photosensitive drum 112 from the laser scanner unit 111.

On that occasion, the photosensitive drum 112 has preliminarily been charged and is formed with an electrostatic latent image by irradiation of light, and subsequently the electrostatic latent image is developed by the developing device 113, thereby forming a toner image on the photosensitive drum.

On the other hand, when a sheet feed signal is output from the controller 140 to the sheet feeding apparatus 103, a sheet S is fed from the sheet containing portion 115. Thereafter, the fed sheet S is conveyed to a transfer portion that is formed of the photosensitive drum 112 and a transfer charger 118 in synchronization with a toner image formed on the photosensitive drum 112 with a registration roller 117.

Then, the sheet having been conveyed to the transfer portion like this is transferred with a toner image, and thereafter conveyed to a fixing portion 114. Further, thereafter, the sheet is heated and pressurized at the fixing portion 114, whereby a transfer image not having been fixed will be permanently fixed to the sheet S. Subsequently, the sheet to which the image has been fixed like this is discharged to a sheet discharge tray 117 from the printer main body 101 with a discharge roller 116.

Figure 2:
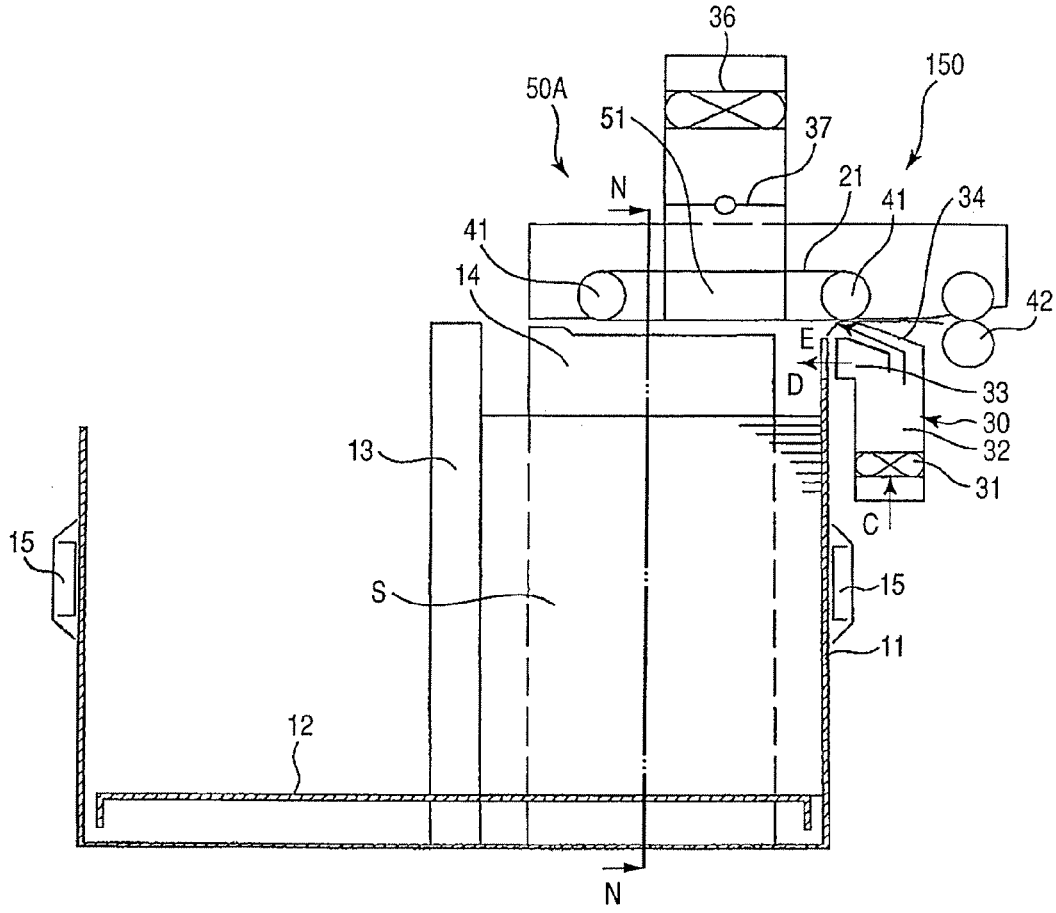
FIG. 2 is a view illustrating construction of the sheet feeding apparatus.
Figure 11:
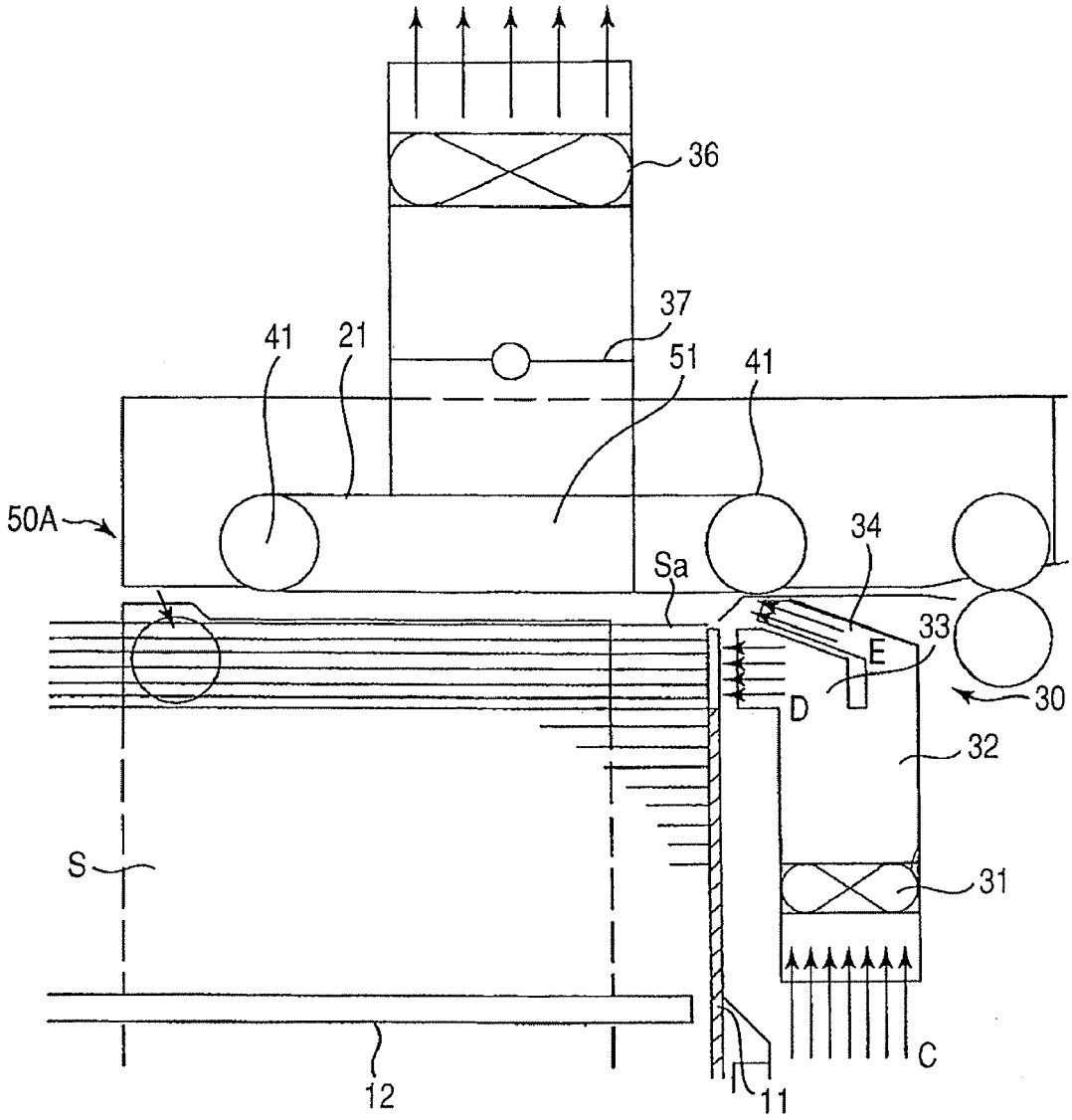
FIG. 11 is a view for illustrating construction of a conventional sheet feeding apparatus.
Figure 12A:
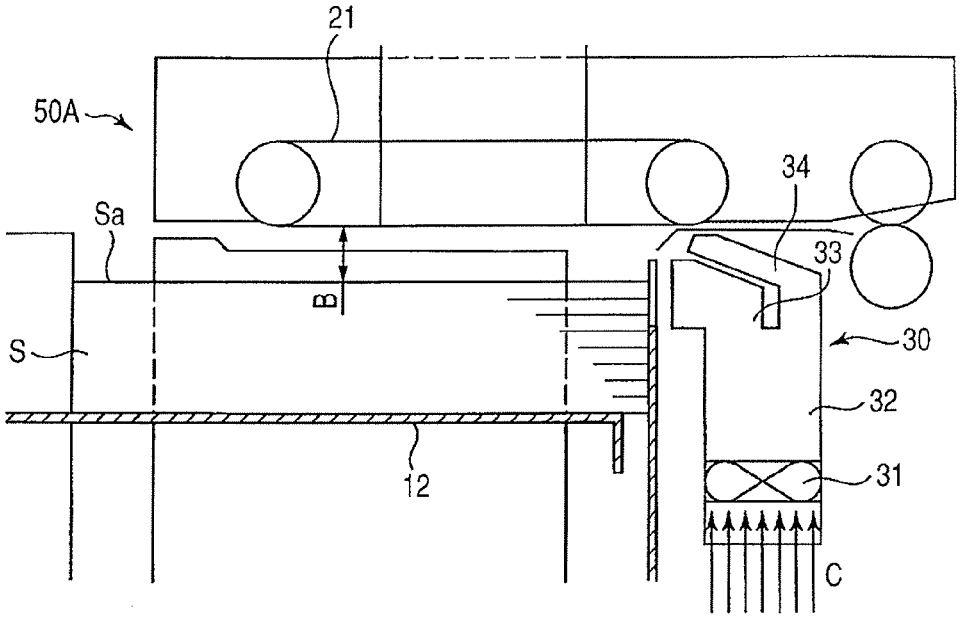
FIG. 12A and FIG. 12B are a first view for illustrating an initial operation in the conventional sheet feeding apparatus.
Figure 12B:
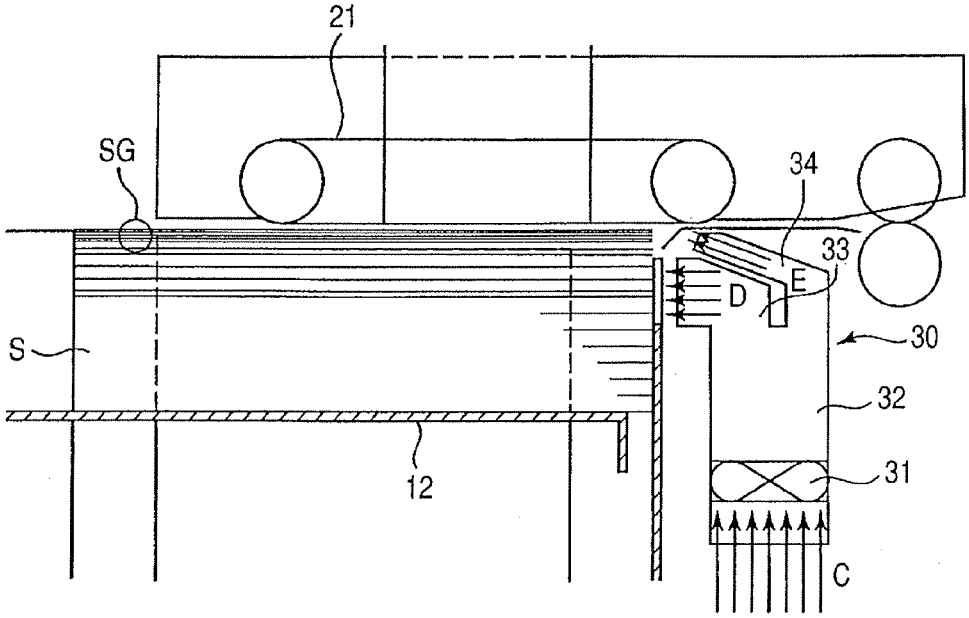
Figure 13A:
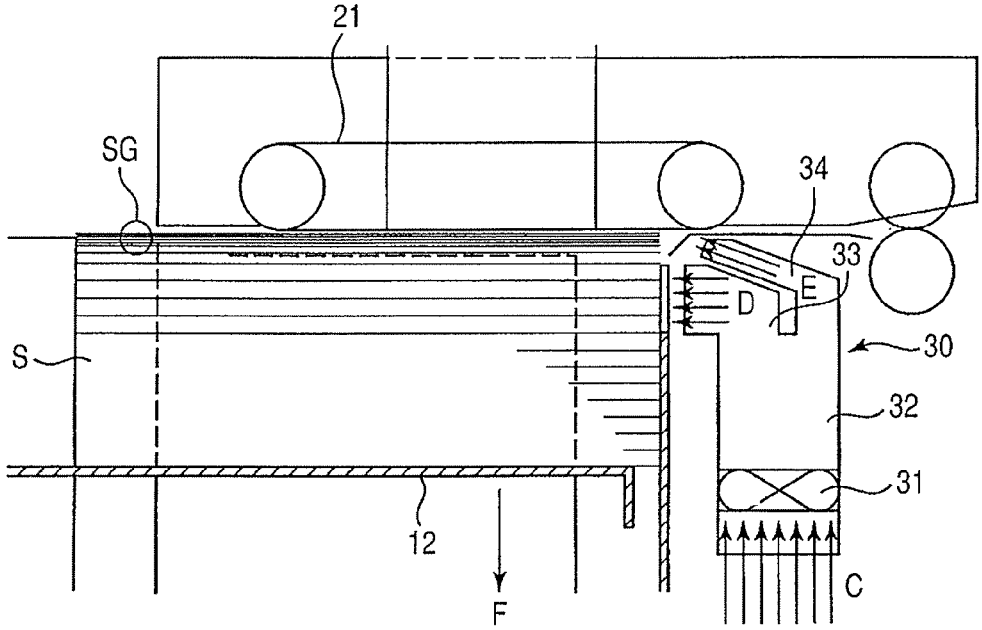
FIG. 13A and FIG. 13B are a second view for illustrating the initial operation in the conventional sheet feeding apparatus.
Figure 13B:
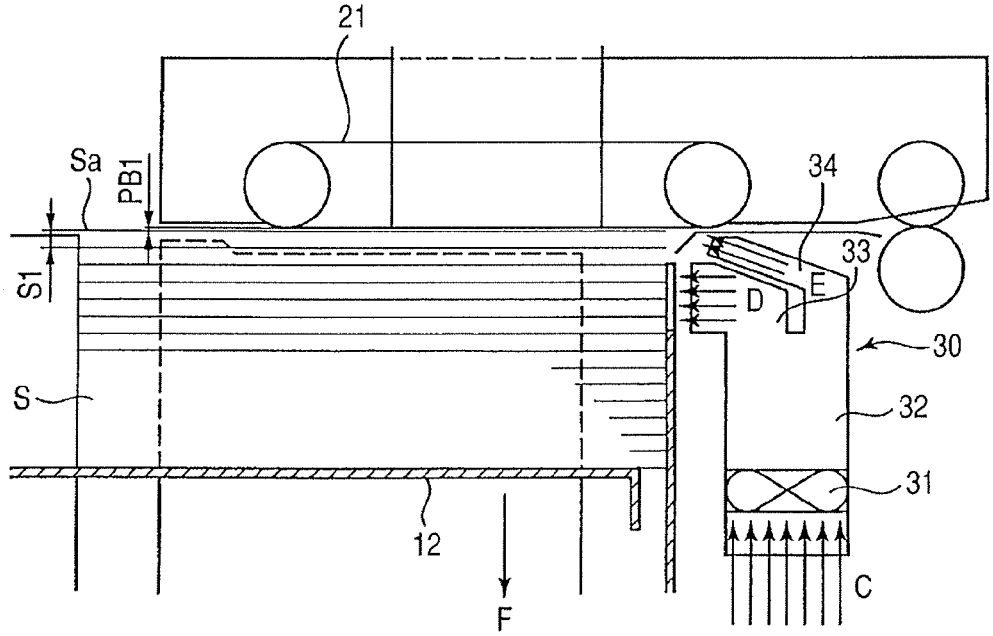

FIG. 2 is a view illustrating construction of the sheet feeding apparatus 103. In FIG. 2, like reference numerals refer to the same or corresponding parts to those of FIG. 11 having been described already.

The storage 11 is provided with a tray 12, a trailing edge regulating plate 13 regulating the upstream side (trailing edge side) in a feeding direction of sheets S, and a side edge regulating plate 14 regulating positions in a width direction orthogonal to a sheet conveying direction of sheets S. Incidentally, the trailing edge regulating plate 13 and the side edge regulating plate 14 are constructed so as to change in any position depending on the size of sheets to be contained. Further, this storage 11 can be drawn out of the printer main body 101 with slide rails 15.

Moreover, there is disposed above this storage 11 a sheet feeding mechanism of air sheet feeding type (hereinafter referred to as an air sheet feeding mechanism 150) acting to separate and feed sheets one by one. This air sheet feeding mechanism 150 is provided with a sucking and conveying portion 50A for sucking and conveying sheets S stacked on the tray 12 and an air blowing portion 30 for blowing up the upper portion of a sheet stack on the tray, as well as for separating the sheets S one by one.

Here, the sucking and conveying portion 50A includes a sucking and conveying belt 21 passed over belt driving rollers 41, as well as sucking and conveying sheets S rightward in FIG. 2 and a suction fan 36 generating a negative pressure for causing the sucking and conveying belt 21 to suck the sheet S. Further, a suction duct 51 is disposed inside the sucking and conveying belt 21. The suction duct 51 sucks air via suction holes (not shown) formed in the suction belt 21. Furthermore, a suction shutter 37 is disposed between the suction fan 36 and the suction duct 51. The suction shutter 37 turns a sucking operation of the sucking and conveying belt 210N or OFF. Moreover, according to this embodiment, a plurality of sucking and conveying belts 21 is disposed at predetermined spaced intervals in a width direction.

Moreover, the air blowing portion 30 includes a loosening nozzle 33 and separation nozzle 34 for blowing air to the upper portion of contained sheets S, a separation fan 31, and a separation duct 32 supplying air from the separation fan 31 to each nozzle 33, 34.

Then, an air sucked in the direction indicated by an arrow C with the separation fan 31 passes through the separation duct 32 and is blown in the direction indicated by an arrow D with the loosening nozzle 33 to cause several sheets of the upper portion of sheets S supported on the tray 12 to blow up. Furthermore, an air sucked in the direction indicated by an arrow C by the separation fan 31 is blown in the direction indicated by an arrow E by the separation nozzle 34, and acts to separate the sheets blown up by the loosening nozzle 33 one by one to be sucked to the sucking and conveying belt 21.

Now, sheet feeding operations of the sheet feeding apparatus 103 of such construction will be described.

Figure 3:
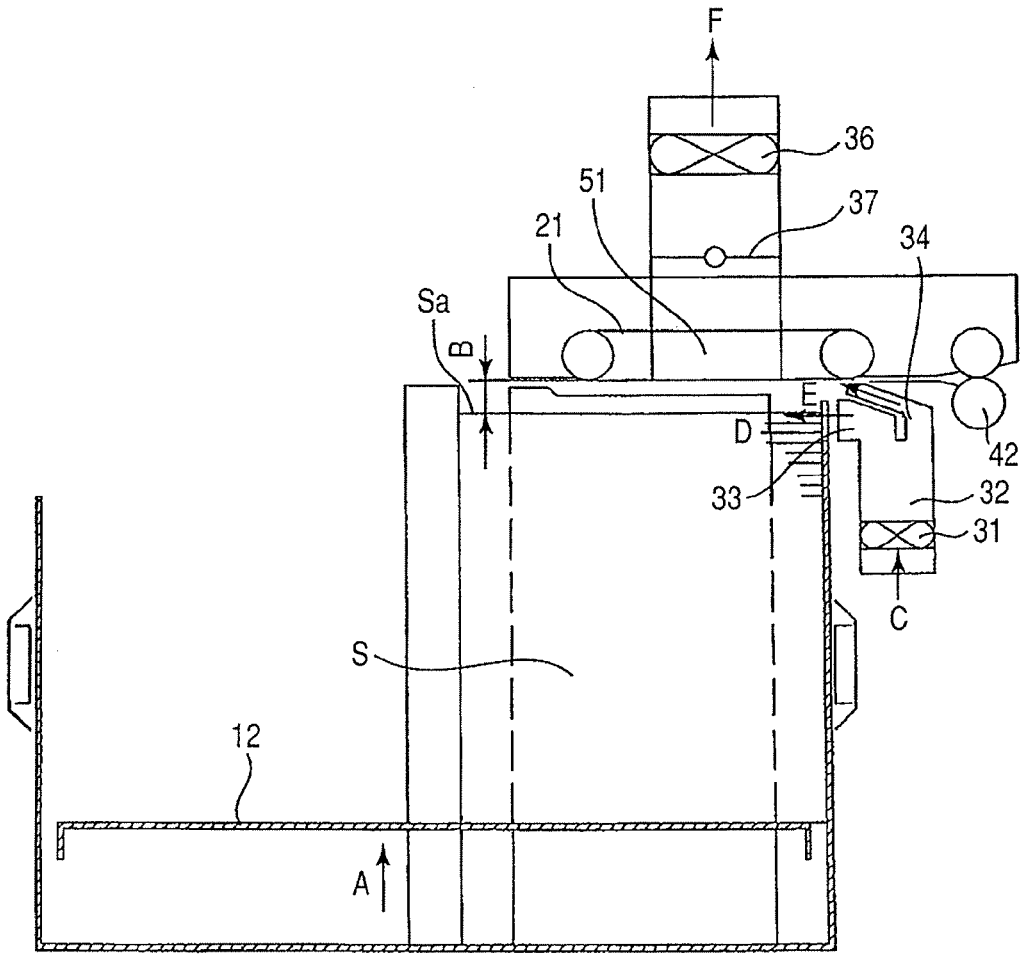
FIG. 3 is a first view for illustrating the sheet feeding operation of the sheet feeding apparatus.

When a user draws out a storage 11 to set sheets S on the tray 12, and thereafter pushes the storage 11 in a predetermined position as illustrated in FIG. 2, the tray 12 starts to rise in the direction indicated by an arrow A by a driving unit (not shown) as illustrated in FIG. 3. Then, when the tray 12 reaches the position capable of feeding sheets where a distance between the uppermost sheet Sa on the tray 12 and the sucking and conveying belt 21 is B, the controller 140 stops the tray 12 in this position. Thereafter, the tray 12 prepare for a sheet feed signal with which feeding is started.

Subsequently, when detecting the sheet feed signal, the controller 140 brings the separation fan 31 in operation. Thus, air is sucked in the direction indicated by an arrow C, and blown to sheets S in respective directions indicated by arrows D and E from the loosening nozzle 33 and the separation nozzle 34 via the separation duct 32. Whereby, several sheets at the upper portion of the sheets S are blown up. Furthermore, the controller 140 brings the suction fan 36 in operation, and thus air is blown out in the direction indicated by an arrow F in FIG. 3. On this occasion, since a suction shutter 37 is still closed, a negative pressure is not created in the suction duct 51.

Figure 4:
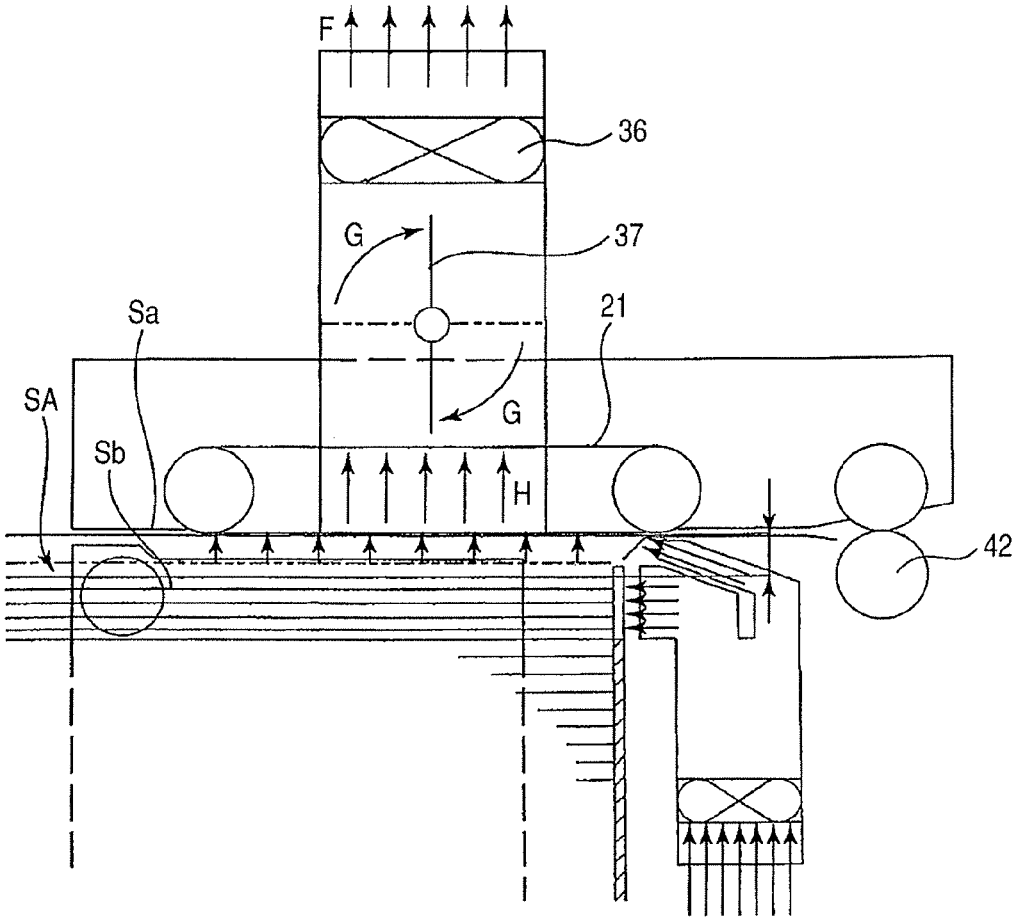
FIG. 4 is a second view for illustrating the sheet feeding operation of the sheet feeding apparatus.

Then, when the below-described initial operation is performed after detection of a sheet feed signal, and thus, as illustrated in FIG. 4, the upper portion of sheets SA have been blown up with stability, the controller 140 rotates the suction shutter 37 in the direction indicated by arrows G to create a negative pressure in the suction duct 51. Whereby, generated is a suction force in the direction indicated by arrows H through suction holes formed in the sucking and conveying belt 21. Thus, with this suction force and an air blown from the separation nozzle 34, only the uppermost sheet Sa is sucked to the sucking and conveying belt 21.

Figure 5:
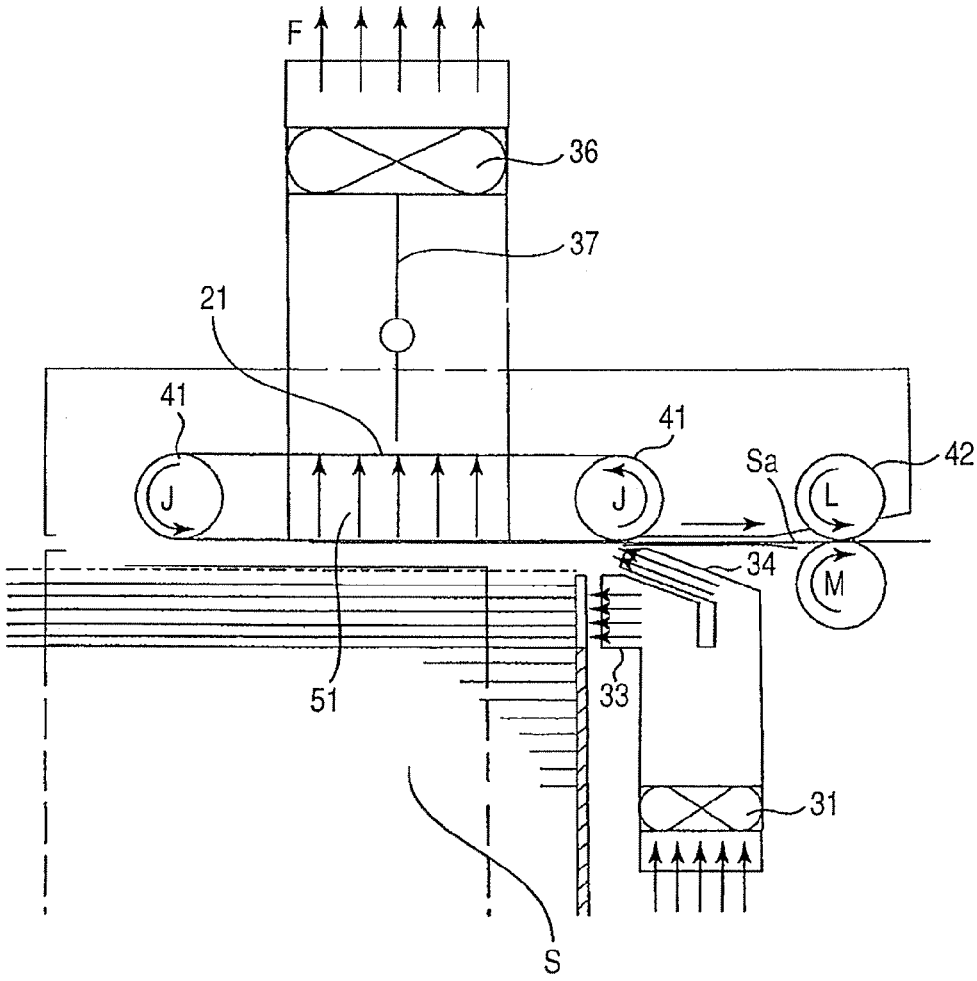
FIG. 5 is a third view for illustrating the sheet feeding operation of the sheet feeding apparatus.

Subsequently, in FIG. 5, a belt driving roller 41 is rotated in the direction indicated by arrows J, whereby the uppermost sheet Sa is conveyed in the direction indicated by an arrow K in the state of being sucked to the sucking and conveying belt 21. Thereafter, by rotation of a pair of drawing rollers 42 in the directions indicated by arrows L and M, the uppermost sheet Sa is fed toward the image forming portion.

Incidentally, to cause a sheet S to be sucked to the sucking and conveying belt 21 like this, the uppermost sheet Sa of the sheets S, which are supported (stacked) on the tray 12, needs to be kept in a predetermined sheet feeding position in which the sucking and conveying belt 21 can suck the uppermost sheet. Therefore, there is provided a sheet detecting mechanism 49 for detecting the uppermost sheet Sa of a sheet stack. To bring the uppermost sheet Sa in an adequate position based on detection of this sheet detecting mechanism 49, a lifting and lowering operation of the tray 12 is controlled.

Now, this sheet detecting mechanism 49 will be described.

Figure 6:
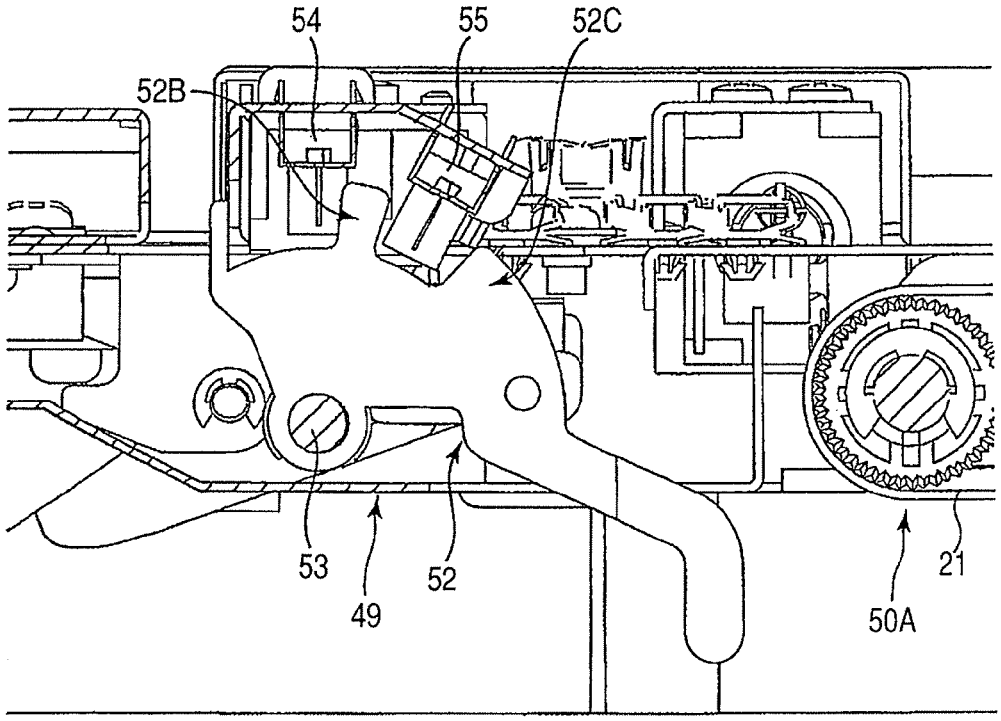
FIG. 6 is a view for illustrating construction of a sheet detecting mechanism provided in the sheet feeding apparatus.

This sheet detecting mechanism 49, as illustrated in FIG. 6, includes a sheet detecting sensor flag 52, a first sheet surface sensor 54 and a second sheet surface sensor 55. The first and second sheet surface sensors 54 and 55 are disposed in a position spaced apart to the upstream side in a sheet feeding direction from the sucking and conveying region (a belt surface onto which a sheet is sucked) of the sucking and conveying belt 21.

Moreover, due to that the first and second sheet surface sensors 54 and 55 are not disposed in the suction duct 51 but in such a position like this, the already-described upsizing of the suction duct 51 can be prevented, and thus downsizing of the printer main body 101 can be achieved.

Here, the sheet detecting sensor flag 52 is supported pivotally about a support shaft 53, and includes a first detecting portion 52B shielding the light-receiving portion of the first sheet surface sensor 54 and a second detecting portion 52C shielding the light-receiving portion of the second sheet surface sensor 55. Moreover, when pressed by a sheet lifted along with the tray 12 as described below, the sheet detecting sensor flag 52 is rocked, and in association with this rocking, the first and second sheet surface sensors 54 and 55 are turned ON or OFF.

In addition, based on the turned-ON or turned-OFF of these first and second sheet surface sensors 54 and 55, the controller 140 lifts and lowers the tray 12. The following table is a summary of lifting and lowering operations of the tray 12 based on such turned-ON and turned-OFF of each of such sheet surface sensors 54 and 55.

TABLE 1

| First sheet surface sensor 54 | Second sheet surface sensor 55 | Tray operation |
|---|---|---|
| ON | OFF | Lifting |
| ON | ON | Stop |
| OFF | ON | Lowering |

Here, the first sheet surface sensor 54 detects that the uppermost sheet Sa has reached the lower limit position in a suckable range in which the sucking and conveying belt 21 can suck the uppermost sheet Sa. Furthermore, the second sheet surface sensor 55 detects that the uppermost sheet Sa has reached the upper limit position of the suckable range.

Figure 7:
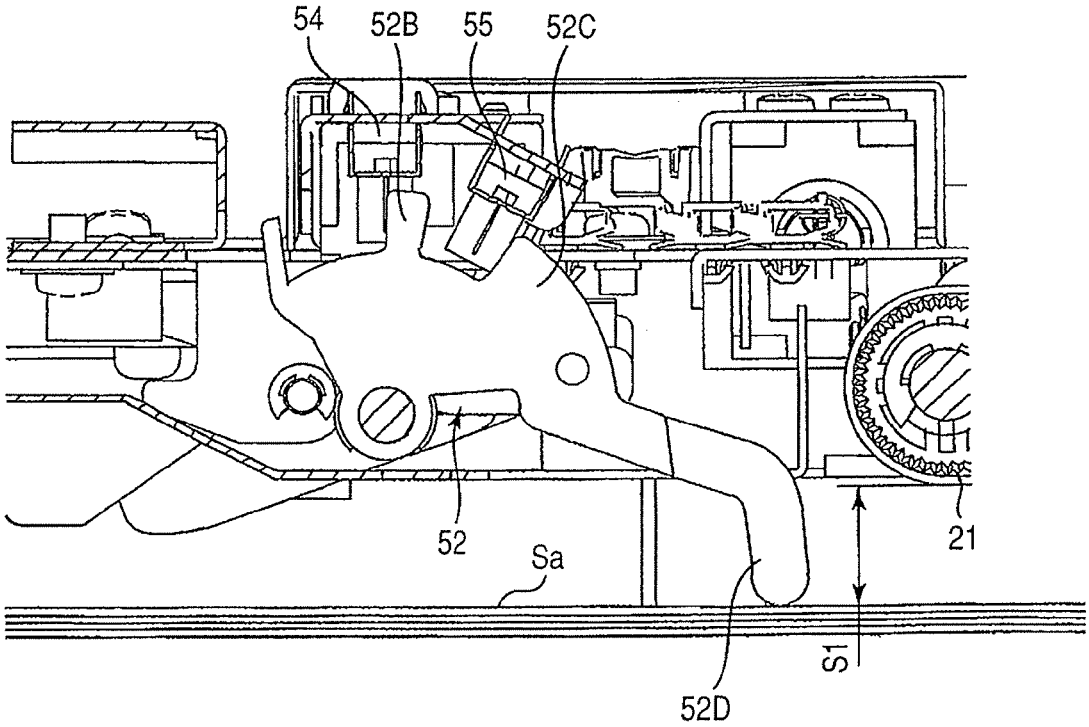
FIG. 7 is a first view for illustrating a sheet surface control operation of the sheet feeding apparatus.
Figure 8:
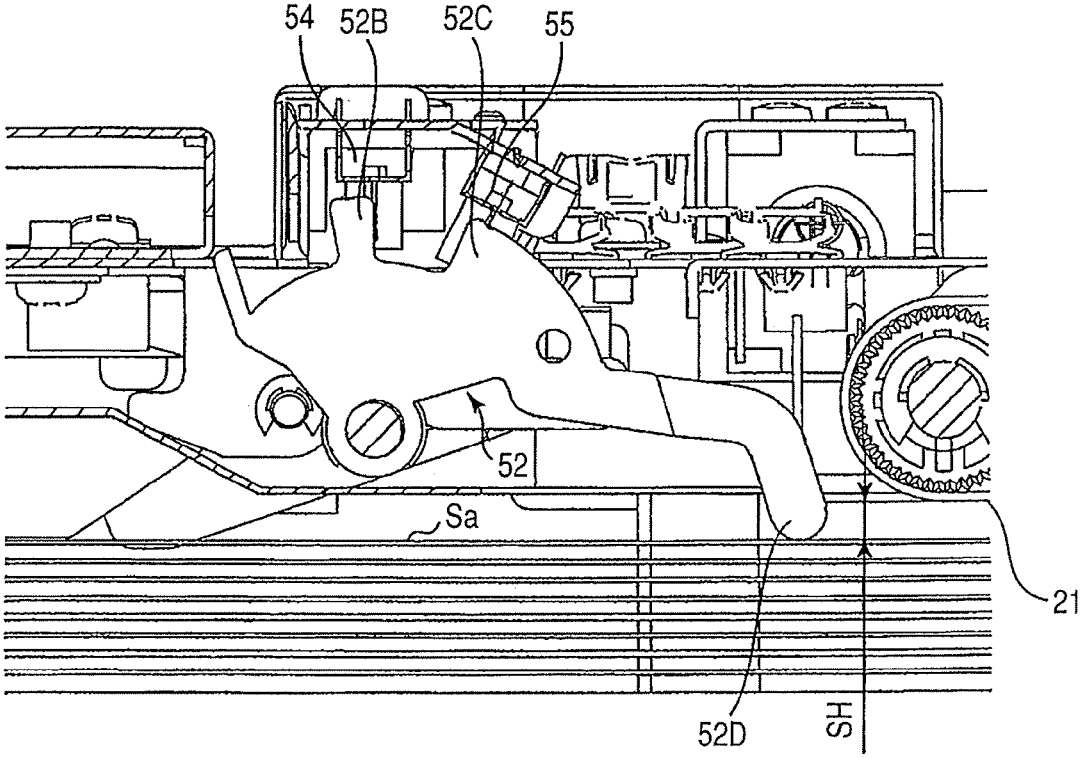
FIG. 8 is a second view for illustrating the sheet surface control operation of the sheet feeding apparatus.

Then, the position (state) in which the first sheet surface sensor 54 and the second sheet surface sensor 55 output ON-signal is an adequate range of the height of the uppermost sheet Sa, that is a suckable range. Here, this suckable range of the uppermost sheet Sa is a range from a position in which the turned-OFF state of the second sheet surface sensor 55 with the turned-ON state of the first sheet surface sensor 54 as illustrated in FIG. 7 is changed to the turned-ON state of the second sheet surface sensor 55 to a position in which the turned-OFF state of the first sheet surface sensor 54 with the turned-ON state of the second sheet surface sensor 55 as illustrated in FIG. 8 is changed to the turned-ON state of the first sheet surface sensor 54.

Figure 9:
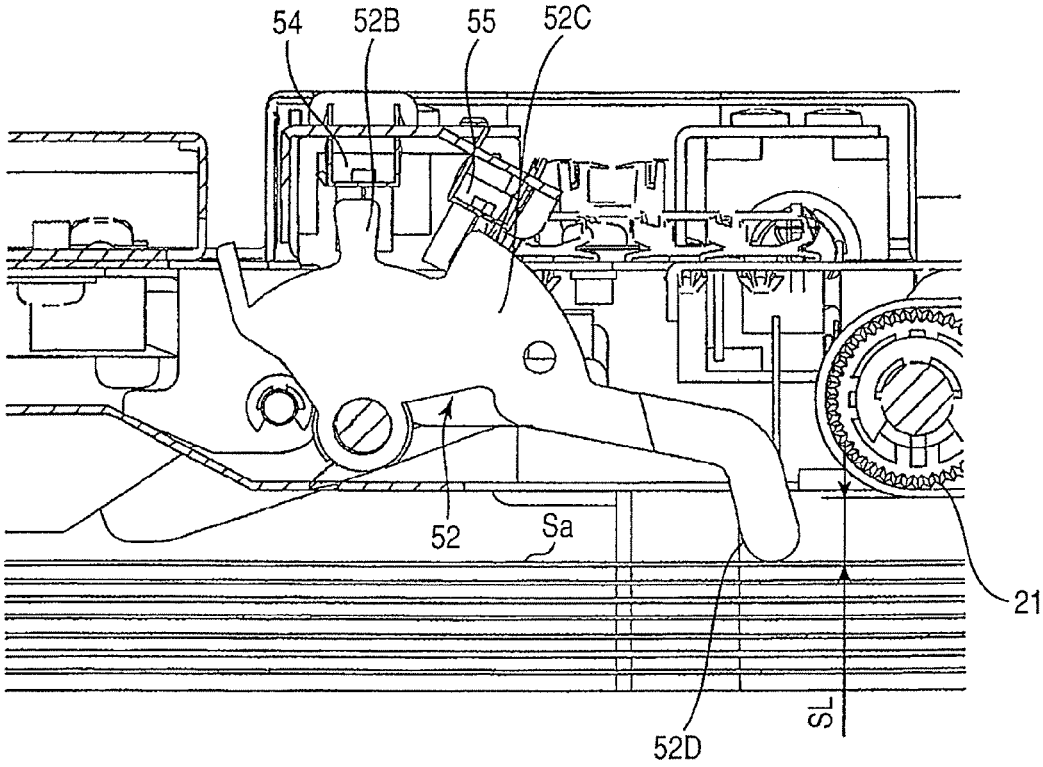
FIG. 9 is a third view for illustrating the sheet surface control operation of the sheet feeding apparatus.

That is, as illustrated in FIG. 9, it is the range in which each of the detecting portions 52B and 52C of the sheet detecting sensor flag 52 shields the corresponding one of the sheet surface sensors 54 and 55 at the same time, and thus both of them are in the turned-ON state. Then, in such a suckable range, that is, when the position in a height direction of the uppermost sheet Sa is within the range of a predetermined height (in the present embodiment, SL-SH is approximately 3 mm), the uppermost sheet Sa can be conveyed.

On the other hand, when the state in which each of the sheet surface sensors 54 and 55 outputs ON-signal within the adequate range is changed to the state in which the uppermost sheet Sa is lowered and thus the second sheet surface sensor 55 is turned OFF, the uppermost sheet Sa is determined to be lowered from the adequate position, and the tray 12 is lifted. This position is set as the lower limit position in the state of the uppermost sheet Sa is blown up.

Moreover, in the case where the uppermost sheet Sa is in a position of being lifted too much, due to construction of the first detecting portion 52B and the second detecting portion 52C of the sheet detecting sensor flag 52, the first sheet surface sensor 54 is turned OFF, and the second sheet surface sensor 55 outputs ON-signal. In the case of such a state, the tray 12 is lowered until each sheet surface sensor 54, 55 outputs ON-signal and the tray 12 is stopped. This stopped position is set as the upper limit position in the state of the uppermost sheet Sa being blown up. That is, the sheet detecting sensor flag 52 is arranged such that when a sheet exceeds the upper limit position in the suckable and conveyable range, the first sheet surface sensor is turned OFF, as well as the second sheet surface sensor is turned ON.

Then, by controlling lifting and lowering of the tray 12 so that the uppermost sheet Sa is positioned between the upper limit position and the lower limit position, sheets can be reliably separated and conveyed with the sucking and conveying belt 21.

Incidentally, in this embodiment, in the case of adding or replacing sheets, the storage 11 is drawn out of the printer main body 101. When the storage 11 is drawn out like this, the tray 12 is lowered to a predetermined position. Whereby, fulfilling and replacing sheets can be made.

Then, after sheets have been e.g., fulfilled or replaced like this, in the below-described initial operation or a sheet feeding operation (sucking and conveying operation), the controller 140 drives a driving unit based on signals from the first and second sheet surface sensors 54 and 55 to control lifting and lowering of the tray 12.

Here, in this embodiment, the controller 140, at the time of lowering of the tray 12 in the below-described initial operation, repeats such a step operation as the tray 12 is lowered for a predetermined time period, and thereafter stopped for a predetermined time period. Incidentally, to enable such a control, a stepping motor or a DC servomotor is employed for a driving unit.

Now, a sheet surface control operation of the controller 140 based on detection of the sheet detecting mechanism 49 of such a construction will be described.

First, a sheet surface control operation when the initial operation has been ended, and sheets are continuously fed will be described.

When the initial operation has been ended, and thereafter, the feeding of sheets is started based on a sheet feed signal, the position of the uppermost sheet Sa is lowered by degrees, and the second sheet surface sensor 55 is turned OFF. In this case, until ON-signal of the second sheet surface sensor 55 is obtained, the position of uppermost sheet Sa is determined to be "too low", and thus the tray 12 is lifted.

Further, as illustrated in FIG. 9, when the distance between the belt surface of the sucking and conveying belt 21 and the upper surface of the uppermost sheets Sa becomes an adequate distance SL, the second sheet surface sensor 55 is shielded from light by the second detecting portion 52B of the sheet detecting sensor flag 52. Whereby, the second sheet surface sensor 55 outputs ON-signal, and when ON-signal is output from the first sheet surface sensor 54 and the second sheet surface sensor 55 like this, the controller 140 stops lifting the tray 12.

As described above, by lifting and lowering the tray 12 based on signals from the first and second sheet surface sensors 54 and 55, control can be made such that only the uppermost sheet Sa is kept in the suckable range within which the sucking and conveying belt 21 can suck, separate and convey a sheet. As a result, when sheets are sucked by the sucking and conveying belt 21, sheets S can be separated one by one, to be singly fed toward the image forming portion 102, thus enabling sheets to be fed with stability.

In addition, there are some cases where the uppermost sheet Sa temporarily exceeds the upper limit position during a sheet feeding operation, and as illustrated in FIG. 8, in the state in which the second sheet surface sensor 55 outputs ON-signal, the first sheet surface sensor 54 is turned OFF. However, in a normal sheet feeding operation, in case of lowering the tray 12 based on this detection, sheets being blown up are not stable, so that no lowering control is made. That is, during a sheet feeding operation, even when the second sheet surface sensor 55 outputs ON-signal, and the first sheet surface sensor 54 is in the turned-OFF state, the tray 12 is not lowered, but stopped.

Now, an initial operation will be described. First, when the storage 11 is drawn out of the printer main body 101, the tray 12 is lowered to a predetermined position, and thus sheets can be refilled or replaced. Then, thereafter, when refilling and the like of sheets are ended, and the storage 11 is mounted in the printer main body 101, an initial operation is performed to lift the tray 12, and the uppermost sheet Sa on the tray 12 will be brought into contact with an contact portion 52D of the sheet detecting sensor flag 52. Incidentally, at this time, the first sheet surface sensor 54 and the second sheet surface sensor 55 are in the turned-OFF state.

Thereafter, when the tray 12 is lifted further, the contact portion 52D is pushed up, and thus the sheet detecting sensor flag 52 is rocked in the counterclockwise direction about the support shaft 53. Then, as illustrated in FIG. 7, when the distance between the upper surface of the uppermost sheet Sa and the belt surface of the sucking and conveying belt 21 comes to be S1, the first sheet surface sensor 54 is shielded by the first detecting portion 52B of the sheet detecting sensor flag 52, and thus the first sheet surface sensor 54 is turned ON.

Note that, at this time, the second sheet surface sensor 55 is in the state of not yet being shielded by the second detecting portion 52C of the sheet detecting sensor flag 52. Then, the controller 140 causes the tray 12 to be lifted further. Whereby, the sheet detecting sensor flag 52 is further rocked, and in association with the rocking, as illustrated in FIG. 8, the second sheet surface sensor 55 is shielded by the second detecting portion 52C of the sheet detecting sensor flag 52, and thus the second sheet surface sensor 55 will be turned ON. Then, when each sheet surface sensor 54, 55 outputs ON-signal like this, the tray 12 is stopped to lift.

Next, air blowing from the loosening nozzle 33 and the separation nozzle 34 is started with respect to the sheets on the stopped tray to blow up the sheets. Here, when air is blown like this, there are some cases where upper sheets of the sheets blown up come close together and blown up with exceeding the already-descried upper limit position.

In this case, a large number of sheets are resided in a position where the distance between the belt surface of the sucking and conveying belt 21 and the upper surface of the uppermost sheet Sa is smaller than SH as illustrated in FIG. 8, thus leading to the state in which sheets cannot be separated and fed.

In this state, the second sheet surface sensor 55 is shielded by the second detecting portion 52C of the sheet detecting sensor flag 52 to output ON-signal, while the first sheet surface sensor 54 is released from being shielded by the first detecting portion 52B to be in the turned-OFF state. Then, in this state, the tray 12 is lowered so as to move the uppermost sheet Sa to the suckable range.

Here, according to this embodiment, thereafter, the tray 12 is not continuously lowered, but, for example, letting an operation in which in one second during a lowering operation, the tray 12 is lowered for 0.3 seconds, and thereafter stopped for 0.7 seconds, be one step, this step is reaped to lower the tray 12. Then, like this, a step lowering operation in which lowering and stop are repeated at the time of lowering the tray 12 is made until both the first sheet surface sensor 54 and the second sheet surface sensor 55 output ON-signal.

Figure 10:
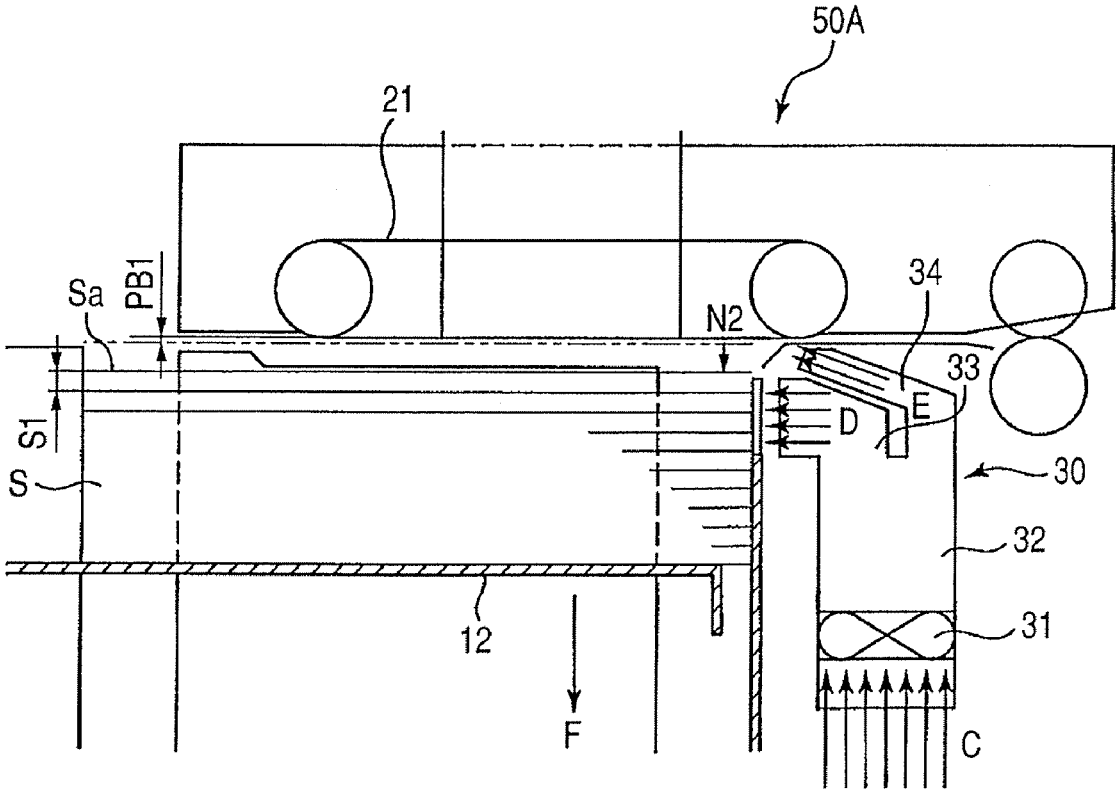
FIG. 10 is a view for illustrating an initial operation in the sheet feeding apparatus.
Figure 14A:
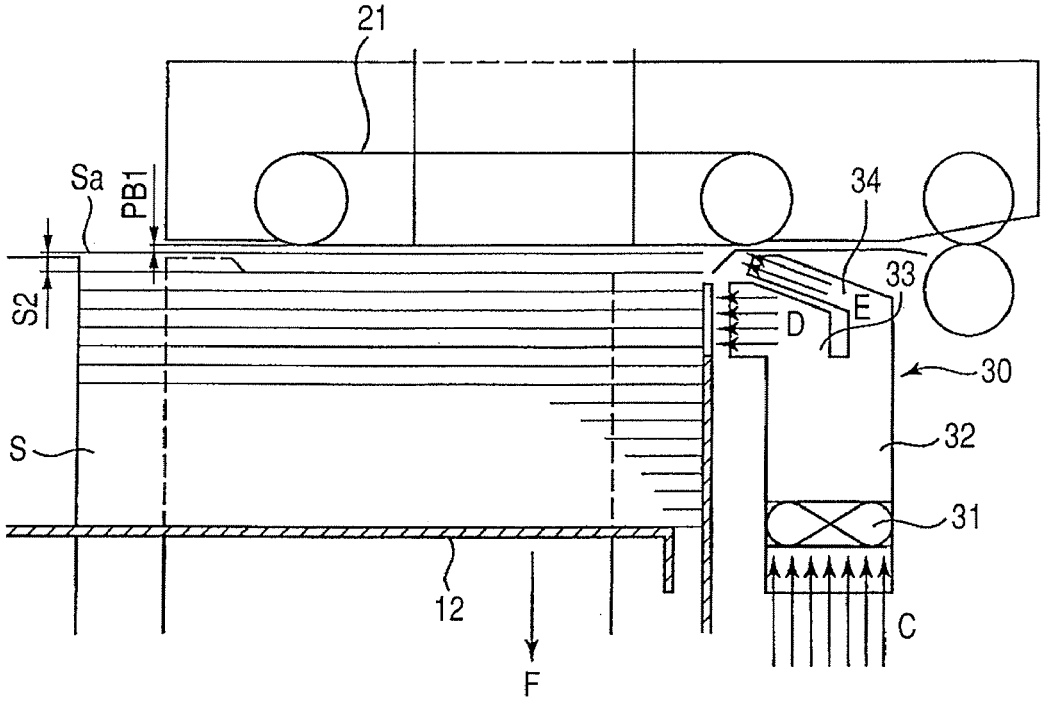
FIG. 14A and FIG. 14B are a third view for illustrating the initial operation in the conventional sheet feeding apparatus.
Figure 14B:
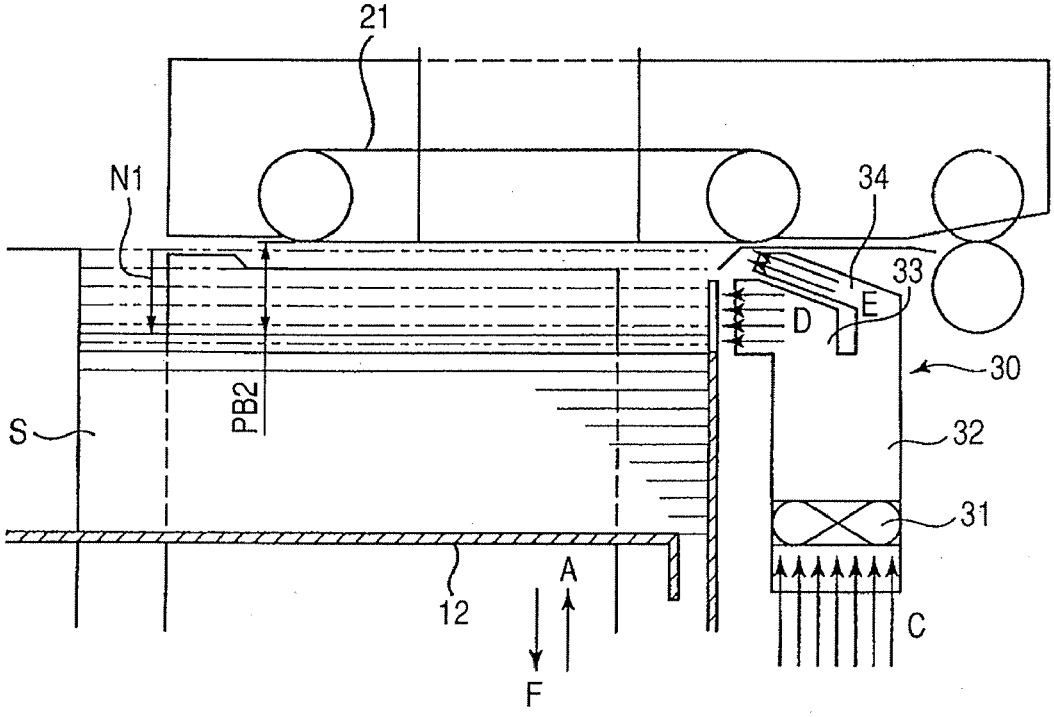

In addition, when lowering and stop operations of the tray 12 are repeated like this, even if sheets blown up try to continue to be blown up while making a space between the sheets larger, since a stop operation is performed in every step operation, the sheets are hard to continue to be blown up, and due to sharply decreased buoyancy, tend to drop. Since, however, the amount of the tray 12 being lowered in one step is small, a drop amount N2 of the uppermost sheet Sa illustrated in FIG. 10 comes to be extremely small as compared with a drop amount N1 in a conventional initial operation (refer to FIG. 14B).

Therefore, the height of the upper surface of the uppermost sheet Sa is not largely deceased, but the uppermost sheet Sa is stepwise lowered by degrees. Like this, since the space between the sheets being blown up comes to be smaller in proportion to the amount of lowering of the tray 12, the uppermost sheet Sa blown up is lowered in proportion to the amount of lowering of the tray 12 as well.

Furthermore, owing to such construction, the tray 12 is not lowered to the state of largely exceeding the lower limit position in the blown up state as is conventional, but the tray 12 is stopped substantially at the lower limit position. Accordingly, thereafter, when the tray 12 is lifted, immediately the uppermost sheet can be positioned in a suckable range. As a result, the tray 12 may no longer repeat a lifting and lowering operation many times resulted from that it can not stop in the vicinity of the lower limit position. Consequently, a rapid as well as stable initial operation can be made.

As described heretofore, at the time of an initial operation, after the tray 12 is lifted above the suckable range, by lowering the tray 12 while repeating a step lowering operation in which a stop operation and a lowering operation for a short time period are performed, the uppermost sheet Sa can be moved to the suckable range rapidly as well as reliably. Whereby, the occurrence of double feed or sheet jamming can be suppressed. Furthermore, by controlling lifting and lowering of the tray 12, since a time period until the uppermost sheet Sa comes to be blown up with stability, becomes smaller, a feeding operation of sheets can be immediately started.

Moreover, in this embodiment, one step of a step lowering operation is set to be one second, and thus a lowering time period and a stop time period in this one step operation is set as appropriate. However, a time period of one step, a tray lowering time period or a tray stop time period in one step may be set to be an optimum value based on the blowing rate (amount) of air from the loosening nozzle 33 and the separation nozzle 34, the lowering velocity of the tray 12 and the like. Furthermore, a time period of one step may be sequentially changed responsive to lowering of the tray 12.

Moreover, in this embodiment, the case where a step lowering operation is performed at the time of an initial operation is described. The present invention, however, is not limited to this case, but other than this initial operation, may be carried out in the case where the tray 12 is lowered for the purpose of moving the uppermost sheet to the suckable range.

This application claims the benefit of Japanese Patent Application No. 2006-134530, filed May 12, 2006, which is hereby incorporated by reference herein in its entirety.

What is claimed is:

1. A sheet feeding apparatus comprising:

a lifting and lowering tray which supports sheets;

an air blowing portion blowing air to an end of the sheets to blow upward the sheets supported on the tray;

a sucking and conveying portion sucking and conveying a sheet blown upward by the air blown by the air blowing portion;

a sheet detecting mechanism detecting an uppermost sheet of the sheets supported on the tray, a controller configured such that when the uppermost sheet blown upward is lowered to a sucking and conveying position range based on detection of an upper surface of the sheet by the sheet detecting mechanism before starting a sucking and conveying operation of a sheet by the sucking and conveying portion, the tray is lowered until the uppermost sheet reaches the sucking and conveying position while repeating a step operation in which a lowering operation and a stop operation are performed, wherein the sheet detecting mechanism includes: a first sheet surface sensor detecting that the uppermost sheet blown upward has reached a lower limit position of the sucking and conveying range; a second sheet surface sensor detecting that the uppermost sheet blown upward has reached an upper limit position of the sucking and conveying range; and a sensor flag moved along with the uppermost sheet blown upward, and arranged to turn the first sheet surface sensor ON when the sheet has reached the lower limit position of the sucking and conveying range, and to turn the first sheet surface sensor OFF as well as to turn the second sheet surface sensor ON when the sheet exceeds the upper limit position of the sucking and conveying range, and wherein the controller is configured such that the tray is lifted when both the first sheet surface sensor and the second sheet surface sensor are turned OFF, and when the first sheet surface sensor is turned ON and the second sheet surface sensor is turned OFF, the tray is lowered when the first sheet surface sensor is turned OFF and the second sheet surface sensor is turned ON, and the tray is stopped when both the first sheet surface sensor and the second sheet surface sensor are turned ON.

2. A sheet feeding apparatus according to claim 1, wherein the controller is configured such that a step operation of performing a lowering operation and a stop operation of the tray is repeated from a state in which the first sheet surface sensor is a turned-OFF state and the second sheet surface sensor is a turned-ON state until both the first sheet surface sensor and the second sheet surface sensor are turned ON.

3. A sheet feeding apparatus according to claim 1, wherein the controller is configured such that a lowering operation time period and a stop operation time period in one step of the step operation of performing the lowering operation and the stop operation of the tray are variable.

4. A sheet feeding apparatus according to claim 1, wherein the controller is configured such that after a sucking and conveying operation of a sheet by the sucking and conveying portion has been started, even if the uppermost sheet is positioned above the suckable range, the tray is not lowered.

5. An image forming apparatus provided with a sheet feeding apparatus for feeding sheets one by one, comprising:

a lifting and lowering tray which supports sheets;

an air blowing portion blowing air to an end of the sheets to blow upward the sheets supported on the tray;

a sucking and conveying portion sucking the sheets blown upward with the air blown by the air blowing portion, and feeding a sheet to an image forming portion;

a sheet detecting mechanism for detecting an uppermost sheet of the sheets supported on the tray, and a controller configured such that when the uppermost sheet blown upward is lowered to a sucking and conveying range based on detection of an upper surface of the sheet by the sheet detecting mechanism before starting a sucking and conveying operation of a sheet by the sucking and conveying portion, the tray is lowered until the uppermost sheet reaches the sucking and conveying range while repeating a step operation in which a lowering operation and a stop operation are performed, wherein the sheet detecting mechanism includes: a first sheet surface sensor detecting that the uppermost sheet blown upward has reached a lower limit position of the sucking and conveying range; a second sheet surface sensor detecting that the uppermost sheet blown has reached an upper limit position of the sucking and conveying range; and a sensor flag moved along with the uppermost sheet blown upward, and arranged to turn the first sheet surface sensor ON when the sheet has reached the lower limit position of the sucking and conveying range, and to turn the first sheet surface sensor OFF as well as to turn the second sheet surface sensor ON when the sheet exceeds the upper limit position of the sucking and conveying range, and wherein the controller is configured such that the tray is lifted when both the first sheet surface sensor and the second sheet surface sensor are turned OFF, and when the first sheet surface sensor is turned ON and the second sheet surface sensor is turned OFF, the tray is lowered when the first sheet surface sensor is turned OFF and the second sheet surface sensor is turned ON, and the tray is stopped when both the first sheet surface sensor and the second sheet surface sensor are turned ON.

6. An image forming apparatus according to claim 5, wherein the controller is configured such that a step operation of performing a lowering operation and a stop operation of the tray is repeated from a state in which the first sheet surface sensor is in a turned-OFF state and the second sheet surface sensor is in a turned-ON state until both the first sheet surface sensor and the second sheet surface sensor are turned ON.

7. An image forming apparatus according to claim 5, wherein the controller is configured such that a lowering operation time period and a stop operation time period in one step of the step operation of performing the lowering operation and the stop operation of the tray is variable.

8. An image forming apparatus according to claim 5, wherein the controller is configured such that after a sucking and conveying operation of a sheet by the sucking and conveying portion has been started, even if the uppermost sheet is positioned above the suckable range, the tray is not lowered.

* * * * *